US010954600B2

(12) United States Patent
Chen et al.

(10) Patent No.: US 10,954,600 B2
(45) Date of Patent: Mar. 23, 2021

(54) ELECTROPLATING SYSTEMS AND METHODS

(71) Applicant: Hamilton Sundstrand Corporation, Charlotte, NC (US)

(72) Inventors: Lei Chen, South Windsor, CT (US); Blair A. Smith, South Windsor, CT (US); Haralambos Cordatos, Colchester, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 35 days.

(21) Appl. No.: 15/382,176

(22) Filed: Dec. 16, 2016

(65) Prior Publication Data

US 2018/0171500 A1 Jun. 21, 2018

(51) Int. Cl.

| | |
|---|---|
| ***C25D 5/08*** | (2006.01) |
| ***C25D 21/04*** | (2006.01) |
| ***C25D 5/06*** | (2006.01) |
| ***C25D 3/66*** | (2006.01) |
| ***C25D 5/00*** | (2006.01) |
| ***C25D 21/10*** | (2006.01) |
| ***C25D 17/02*** | (2006.01) |
| ***C25D 17/00*** | (2006.01) |

(52) U.S. Cl.

CPC ..... *C25D 5/003* (2013.01); *C25D 3/665* (2013.01); *C25D 5/06* (2013.01); *C25D 5/08* (2013.01); *C25D 17/00* (2013.01); *C25D 17/02* (2013.01); *C25D 21/04* (2013.01); *C25D 21/10* (2013.01)

(58) Field of Classification Search

CPC ..... C25D 5/06; C25D 3/44; C25D 3/66–665

See application file for complete search history.

(56) References Cited

U.S. PATENT DOCUMENTS 5,688,306 A * 11/1997 Verini ..... B01D 53/22 95/15
5,840,266 A * 11/1998 Lewin ..... C01B 7/191 423/483

(Continued)

FOREIGN PATENT DOCUMENTS

CH 650543 A5 * 7/1985 ..... E06B 9/04
CN 201339068 Y * 11/2009

(Continued)

OTHER PUBLICATIONS

Arato et al., Machine Translation, CH-650543-A5 (Year: 1985).*

(Continued)

*Primary Examiner* — Brian W Cohen
*Assistant Examiner* — Ho-Sung Chung
(74) *Attorney, Agent, or Firm* — Locke Lord LLP; Scott D. Wofsy; Georgi Korobanov

(57) ABSTRACT

An electroplating system includes an enclosure with an interior, an anode lead extending through the enclosure and into the interior, and a porous body. The porous body is supported within the interior of the enclosure for coupling an electroplating solution within the interior with a workpiece. A conduit extends through the enclosure and into the interior of the enclosure to provide a flow of nitrogen enriched air to the interior of enclosure for drying and removing oxygen from the electroplating solution.

15 Claims, 4 Drawing Sheets

(56) References Cited

U.S. PATENT DOCUMENTS

| | | | | |
|---|---|---|---|---|
| 6,372,345 | B1 * | 4/2002 | Wakae | C25D 15/02 205/109 |
| 2004/0173468 | A1 | 9/2004 | Henuset | |
| 2006/0169137 | A1 * | 8/2006 | Roks | B01D 53/22 95/22 |
| 2011/0024299 | A1 * | 2/2011 | Reusmann | C25D 15/00 205/50 |
| 2016/0108534 | A1 * | 4/2016 | Dai | C25D 5/02 205/117 |
| 2016/0190545 | A1 * | 6/2016 | Momo | H01M 4/0452 429/231.95 |

FOREIGN PATENT DOCUMENTS

| | | | |
|---|---|---|---|
| EP | 3103895 | A1 | 12/2016 |
| WO | WO-0228714 | A1 | 4/2002 |

OTHER PUBLICATIONS

Su, Machine Translation, CN-201339068-Y (Year: 2013).*
Su, Partial Human Translation, CN-201339068-Y (Year: 2013).*
Extended European Search Report received from the European Patent Office (EPO) dated Feb. 19, 2018 for Application No. 17207800.8.

* cited by examiner

ELECTROPLATING SYSTEMS AND METHODS

BACKGROUND OF THE INVENTION

1. Field of the Invention

The present disclosure relates to electroplating, and more particularly electroplating aluminum coatings on structures traditionally coated with cadmium.

2. Description of Related Art

Cadmium is commonly used to provide corrosion protection on structural components subject to corrosive environments. In additional to corrosion protection, cadmium also provides lubricity to the protected structure and has excellent adhesion to steel, making the cadmium desirable for certain types of steel structural components subject to corrosive environments. In the context of aircraft, examples of such structural components typically coated with cadmium include fasteners, propeller barrels, electrical components, and press-fit high-strength steel bolts such as those used in turboprop propeller assemblies.

Cadmium is a heavy metal and is considered a substance of concern by the European Chemicals Agency (ECHA), which listed cadmium as a substance of very high concern (SVHC). ECHA is the driving force among regulator authorities implementing EC-Regulation No. 1907/2006 on Registration, Evaluation, Authorization, and restriction of Chemicals (REACH). As such alternatives to cadmium have been developed, including coatings comprising a tin-zinc, zinc-nickel, zinc flake, or aluminum flake deposited on the substrate to be protected and overlayed by a fluoropolymer topcoat to resist damage to the coating.

Such conventional methods and systems have generally been considered satisfactory for their intended purpose. However, there is still a need in the art for improved coatings and methods for applying coatings. The present disclosure provides a solution for this need.

SUMMARY OF THE INVENTION

An electroplating system includes an enclosure with an interior, an anode lead extending through the enclosure and into the interior, and a porous body. The porous body is supported within the interior of the enclosure for coupling an electroplating solution within the interior with a workpiece. A conduit extends through the enclosure and into the interior of the enclosure to provide a flow of nitrogen enriched air to the interior of enclosure for drying and removing oxygen from the electroplating solution.

In certain embodiments, the system can include an anode. The anode can be supported within the interior of the enclosure. The anode lead can be electrically connected to the anode. The system can include an electrolyte. The electrolyte can be contained with the enclosure interior. The electrolyte can saturate the porous member. The anode can be immersed within the electrolyte. The enclosure can include a workpiece aperture. The workpiece aperture can be bounded by the porous member. A gasket can extend about the workpiece aperture for compressively sealing the enclosure about a workpiece seated in the workpiece aperture.

In accordance with certain embodiments, the system can include an air separation module. The air separation module can be in fluid communication with the enclosure interior through purge inlet port and a purge vent port. An air separator can be in fluid communication with the enclosure interior through the purge inlet port. The air separator can be configured to provide a flow of nitrogen-enriched air to the interior of the enclosure. The air separator can be arranged to remove either or both oxygen and moisture from a flow of compressed air provided to the air separator. The air separator can include a membrane for removing water vapor or both water vapor and oxygen from compressed air provided to the air separator. The purge inlet port can be arranged within an ullage space above the surface of electrolyte within the enclosure interior. The purge inlet port can be arranged below the surface of electrolyte contained within the enclosure interior.

It is also contemplated that, in accordance with certain embodiments, the system can include a recirculation module. The recirculation module can include a tap and a return. The tap can be separated from the return by the porous member. The return can be separated from the porous member by the anode. A recirculation pump can be arranged between the tap and the return. It is contemplated that the enclosure interior can be divided into a supply chamber and a return chamber fluidly connected to one another by the porous member. The tap can be fluidly coupled to the return chamber. The return can be fluidly coupled to the supply chamber. In further embodiments the electroplating apparatus can be portable and/or handheld for local or in-situ electroplating of substrates.

A method of electroplating a workpiece includes seating an enclosure on a workpiece, flowing dry nitrogen-enriched air through the interior of the enclosure, and applying a potential difference between the workpiece and an anode submerged within electrolyte contained within the interior of the enclosure. In certain embodiments the enclosure is seated on only a portion of the workpiece abutting the enclosure. The substrate can include steel, the anode can include aluminum, and the electrolyte can be mechanically agitated and/or dried by issuing the nitrogen-enriched air into the electrolyte. It is also contemplated that the electrolyte can be re-circulated from a location within the enclosure and adjacent to the workpiece to a location within the enclosure on a side of the anode opposite the workpiece.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE PREFERRED EMBODIMENTS

Figure 1:
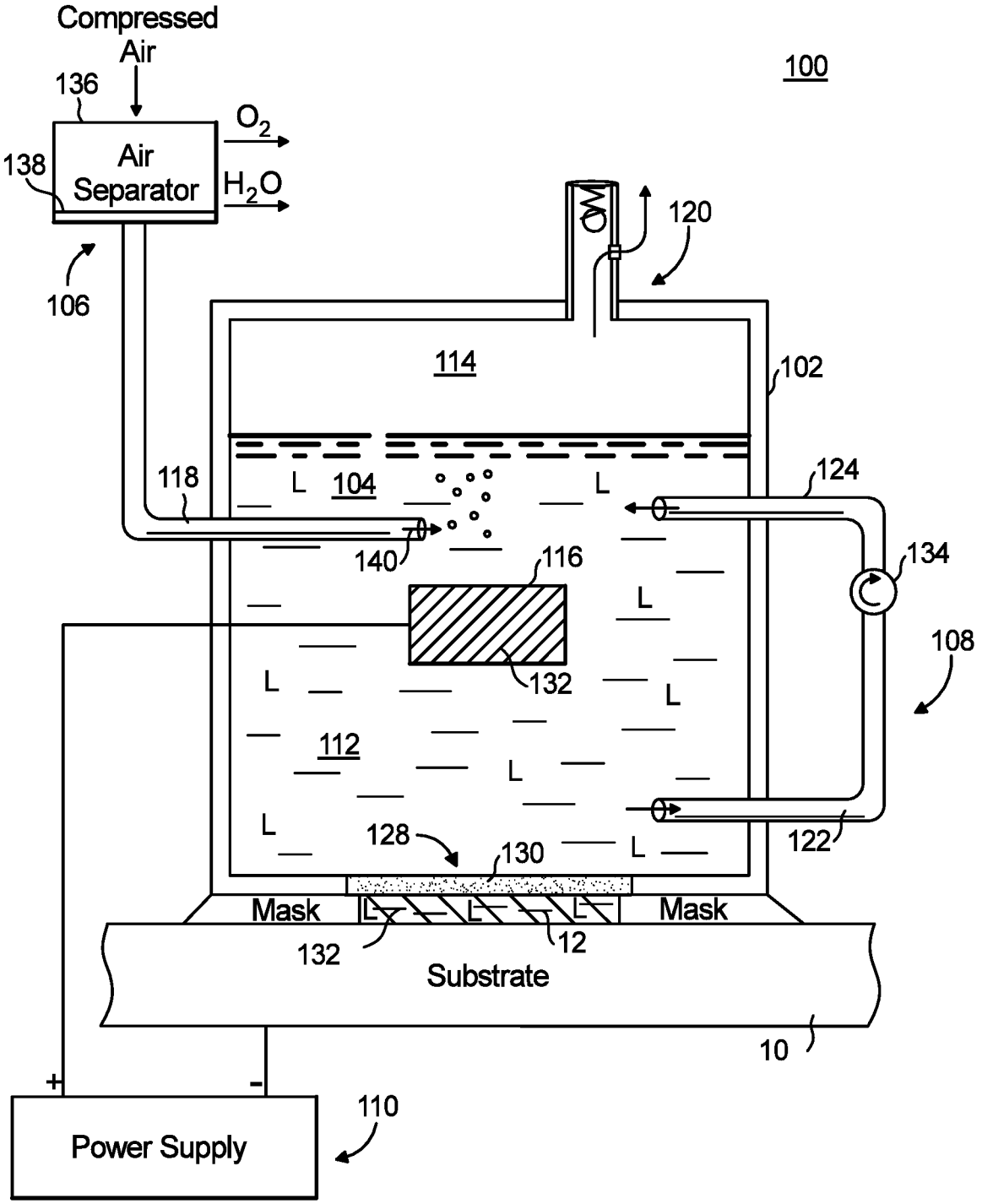
FIG. 1 is a schematic side view of an exemplary embodiment of an electroplating apparatus constructed in accordance with the present disclosure, showing an enclosure containing an electrolyte mounted to a substrate for in-situ coating of the substrate.

Reference will now be made to the drawings wherein like reference numerals identify similar structural features or aspects of the subject disclosure. For purposes of explanation and illustration, and not limitation, a partial view of an exemplary embodiment of an electroplating apparatus in accordance with the disclosure is shown in FIG. 1 and is designated generally by reference character 100. Other embodiments of electroplating systems and methods of depositing coatings in accordance with the disclosure, or aspects thereof, are provided in FIGS. 2-4, as will be described. The systems and methods described herein can be used for in-situ and local electroplating of substrate with non-cadmium coatings, such as aluminum coatings, though the present disclosure is not limited to aluminum coatings or to in-situ and local electroplating in general.

Referring to FIG. 1, electroplating apparatus 100 is shown. Electroplating system 100 includes an enclosure 102 with an interior 104, an air separation module 106, an electrolyte recirculation module 108, and a power supply 110. An electrolyte 112 is contained within enclosure interior 104, a surface of electrolyte 112 and the top (relative to gravity) of enclosure 102 defining therebetween an ullage space 114. An anode 116 is arranged within interior 104.

Enclosure 102 includes a plurality of ports. In this respect enclosure 102 includes a purge inlet port 118, a purge outlet port 120, a recirculation output port 122, and a recirculation return port 124. Purge inlet port 118 fluidly couples air separation module 106 to enclosure interior 104. Purge outlet port 120 fluidly connects enclosure interior 104 to the ambient environment outside of enclosure 102. Purge outlet port 120 includes a one-way valve arranged to allow one way fluid communication with the external environment to allow interior 104 to have a greater pressure than the ambient environment while not allowing leakage of electrolyte 112 from enclosure 102. Recirculation outlet port 122 and recirculation return port 124 each fluidly couple enclosure interior 104 with recirculation module 106.

In the illustrated exemplary embodiment enclosure 102 also has a workpiece aperture 128. Workpiece aperture 128 is arranged in a lower portion (relative to gravity) of enclosure 102 and provides access to a substrate 10 for coating. A porous body 130 is seated within workpiece aperture 128, porous body 130 including a brush or foam element which limits fluid communication between the external environment and enclosure interior 104 while allowing sufficient fluid communication for a coating 12 to develop over the surface of substrate 10. Porous body 130 can be seated in the bottom (relative to gravity) of enclosure 102, porous body 130 allowing a sufficient amount of electrolyte to pass therethrough for plating the underlying substrate, porous body 130 substantially retaining electrolyte within enclosure 102 when electroplating apparatus 100 is removed from contact with the workpiece, e.g., substrate 10, i.e. not during plating.

In the illustrated exemplary embodiment substrate 10 is masked, the masking cooperating with porous body 130 to develop coating 12 at desired location on substrate 10. Porous body 130 can be formed from a synthetic sponge material, such as polyester or polyether by way of non-limiting example.

Anode 116 includes a metallic material 132 which is sacrificial. Metallic material 132 provides a source of metallic ions for electrolyte 112 which deposit on substrate 10 as coating 12. In certain embodiments metallic material 132 includes aluminum. As will be appreciated by those of skill in the art in view of the present disclosure, aluminum has the advantage of providing corrosion protection to underlying substrates, for example steel-containing substrates, similar to that provided by cadmium. Aluminum has the additional advantage that, when deposited using an electroplating technique, the resulting deposition can have adhesion to the underlying substrate similar to that of cadmium. Although described herein as containing aluminum, it is to be understood and appreciated that other materials like Al—Mn, Al—Mo, Al—In, or Al—Zn containing coatings can also be deposited using the apparatus and method described herein.

Electrolyte 112 includes an ionic liquid which conveys metallic material 132 to substrate 10. As will be appreciated by those of skill in the art in view of the present disclosure, ionic liquids allow for environmentally friendly, solvent-free plating of materials with corrosion protection properties similar to that of cadmium, such as aluminum. Ionic liquids also allow for coating of materials like aluminum without the use of a pyrophoric chemistry, which can be difficult to implement in an in-situ application. Examples of suitable ionic liquids include Lewis acidic dialkylimidazolium-based chloroaluminate, including 1-ethyl-3-methylimidazoleum chloride [EMIM][C]-AlCl3, 1-butyl-3-methylimidizolium chloride [BMIL][C]-AlCl3, and combinations thereof.

In certain embodiments, a solid lubricant L can be dispersed within electrolyte 112 for co-deposition during electroplating. Inclusion of solid lubricant enables deposition of non-cadmium protective layers, e.g., coating 12, with lubricity similar to that of cadmium. Examples of suitable lubricants include transition-metal dichalcogenides, MX2 (where M is Mo, W, Nb, Ta, etc., and X is sulfur, selenium, or tellurium), polytetrafluoroethylene (PTFE), diamond, diamond-like carbon (DLC), graphite, and boron nitride (BN).

Recirculation module 108 has a recirculation pump 134. Recirculation pump 134 is fluidly coupled between recirculation outlet port 122 and recirculation return port 124 and is arranged to draw and return electrolyte to enclosure interior 104. Recirculation module 108 can be arranged to supply dry inerting gas, e.g., a flow of dry nitrogen-enriched air to the enclosure interior for sustaining plating using a non-aqueous electrolyte. As will be appreciated by those of skill in the art in view of the present disclosure, drawing and returning electrolyte can alternatively or additional agitate electrolyte 112, maintaining homogeneity of electrolyte 112.

Air separation module 106 includes an air separator 136. Air separator 136 is fluidly coupled to enclosure interior 104 through inlet port 118 and is arranged to provide thereto a flow of purge gas. In certain embodiments the flow of purge gas is dry nitrogen-enriched air 140. In the illustrated exemplary embodiment air separator 136 is arranged to generate the flow of dry nitrogen-enriched air 140 from a flow of compressed air, from which it separates oxygen and moisture using a membrane arrangement 138, and provides to enclosure interior 104. Use of an air separator provides a sufficiently inert atmosphere within enclosure interior 104 for coating reactive materials like aluminum while not requiring the comparatively extensive infrastructure necessary for a depot or factory-type coating line. This allows for in-situ or local coating, allowing coating apparatus to be set up at the workpiece, e.g., substrate 10, instead of removing substrate 10 from its installed location for repair at a depot or factory-type environment. In the illustrated embodiment inlet port 118 introduces dry nitrogen-enriched air 140 within liquid electrolyte 112, drying the liquid electrolyte 112 such that moisture is removed by gas exiting enclosure 102 through purge outlet port 120. As will be appreciated by those of skill in the art in view of the present disclosure, introducing dry nitrogen-enriched air 140 directly into liquid electrolyte 112 also agitates the liquid, improving homogeneity of liquid electrolyte 112.

In certain embodiments, electroplating apparatus 100 is portable. In this respect portable electroplating apparatus 100 can be brought to a location where coating is to be performed. For example, portable electroplating apparatus can be brought to an airfield to repair coatings on parts removed from aircraft brought to the airfield for repair. In accordance with certain embodiments electroplating apparatus 100 can be handheld. In this respect handheld electroplating apparatus can be brought to the location of an article to be repaired, such as to propeller assembly stud emplaced in an aircraft on a flight line, for coating repair at the location of the article to be repaired.

Figure 2:
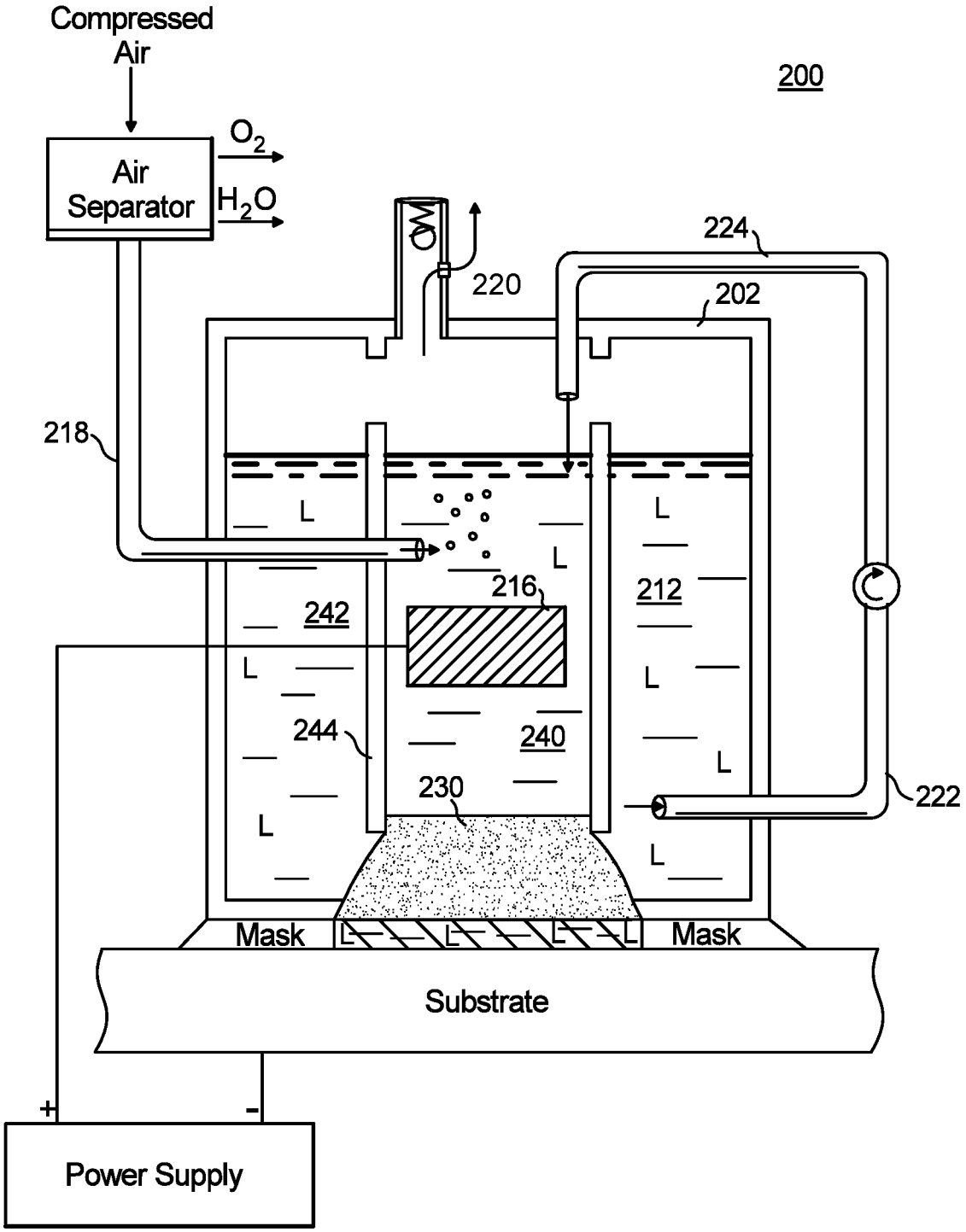
FIG. 2 is a schematic view of another exemplary embodiment of an electroplating apparatus, showing an enclosure with an interior partitioned into an inner and an outer chamber mounted to a substrate for in-situ coating of the substrate.

With reference to FIG. 2, an electroplating apparatus 200 is shown. Electroplating apparatus 200 is similar to electroplating apparatus 100 and additionally includes a partitioned enclosure 202. Partitioned enclosure 202 has an inner chamber 240 and an outer chamber 242 and is separated therefrom by a wall 244. Inner chamber 240 is in liquid communication with outer chamber 242 through a porous body 230 seated between inner chamber 240 and outer chamber 240, an anode 216 being disposed within inner chamber 240 and submerged within electrolyte 212.

A recirculation outlet port 222 is in fluid communication with outer chamber 242. Recirculation inlet port 224 is arranged within inner chamber 240 to recirculate electrolyte into inner chamber 240. Purge outlet port 220 is also in fluid communication with inner chamber 240, dry nitrogen-enriched air provided to inner chamber 240 from purge inlet port 218 exiting therethrough once having traversed liquid electrolyte 212.

Figure 3:
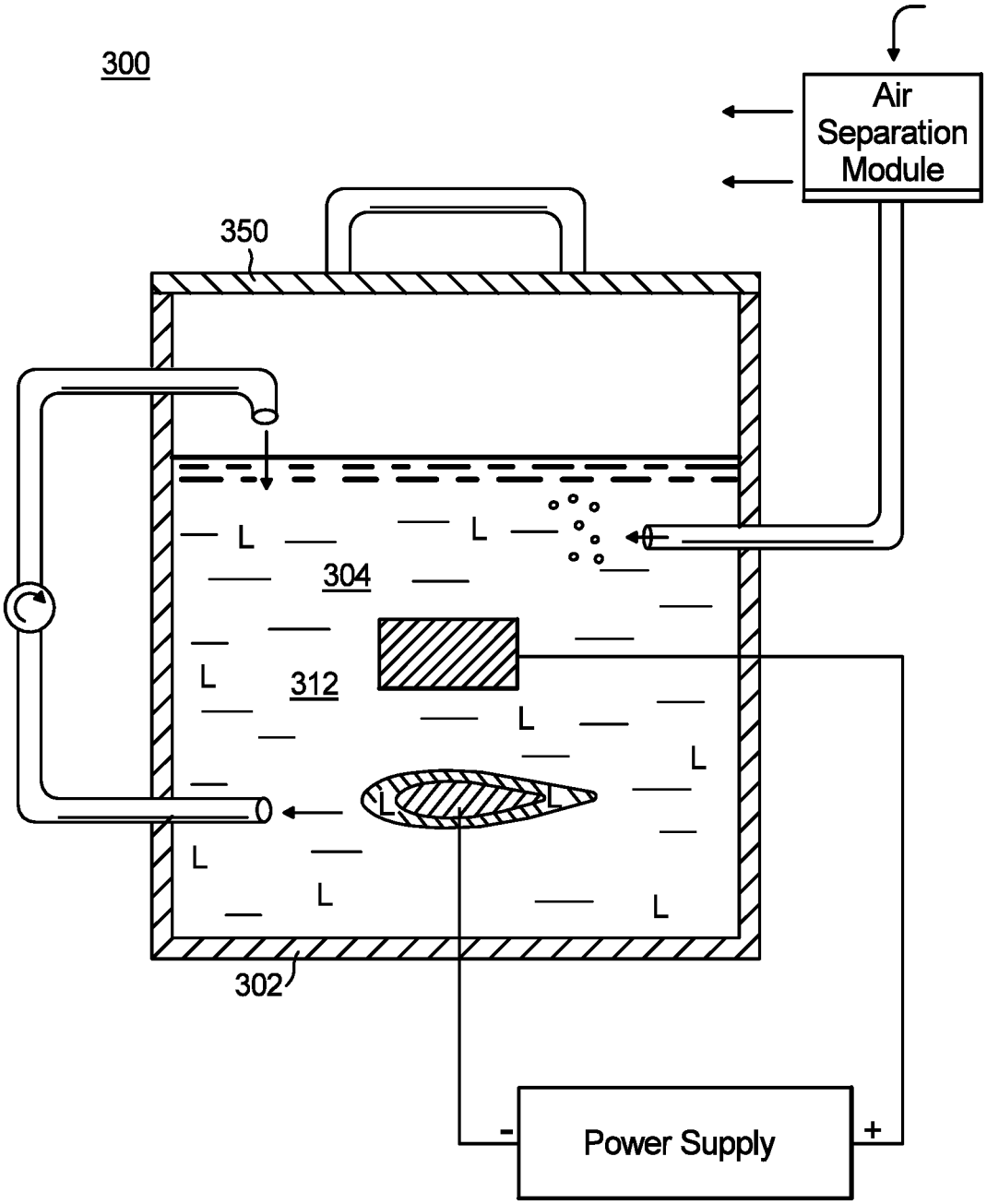
FIG. 3 is a schematic view of another exemplary embodiment of an electroplating apparatus, showing a substrate immersed within the apparatus enclosure for localized coating of the substrate.

With reference to FIG. 3, an electroplating apparatus 300 is shown. Electroplating apparatus 300 is similar to electroplating apparatus 100 with the difference that it is arranged for immersion coating of substrate, e.g., substrate 10. In this respect substrate enclosure 302 includes a removable hatch 350, which allows introduction of substrate 10 into interior 304 of enclosure 302. Once placed therein hatch 350 is sealably joined to enclosure 302, interior 304 purged, electrolyte 312 introduced into interior 304, and substrate 10 coated using the electroplating method described above. This allows for local coating of workpieces, e.g., substrate 10, such as in proximity to the flight line, without the need to return substrate 10 to a depot or factory-type environment for overhaul and/or repair.

Figure 4:
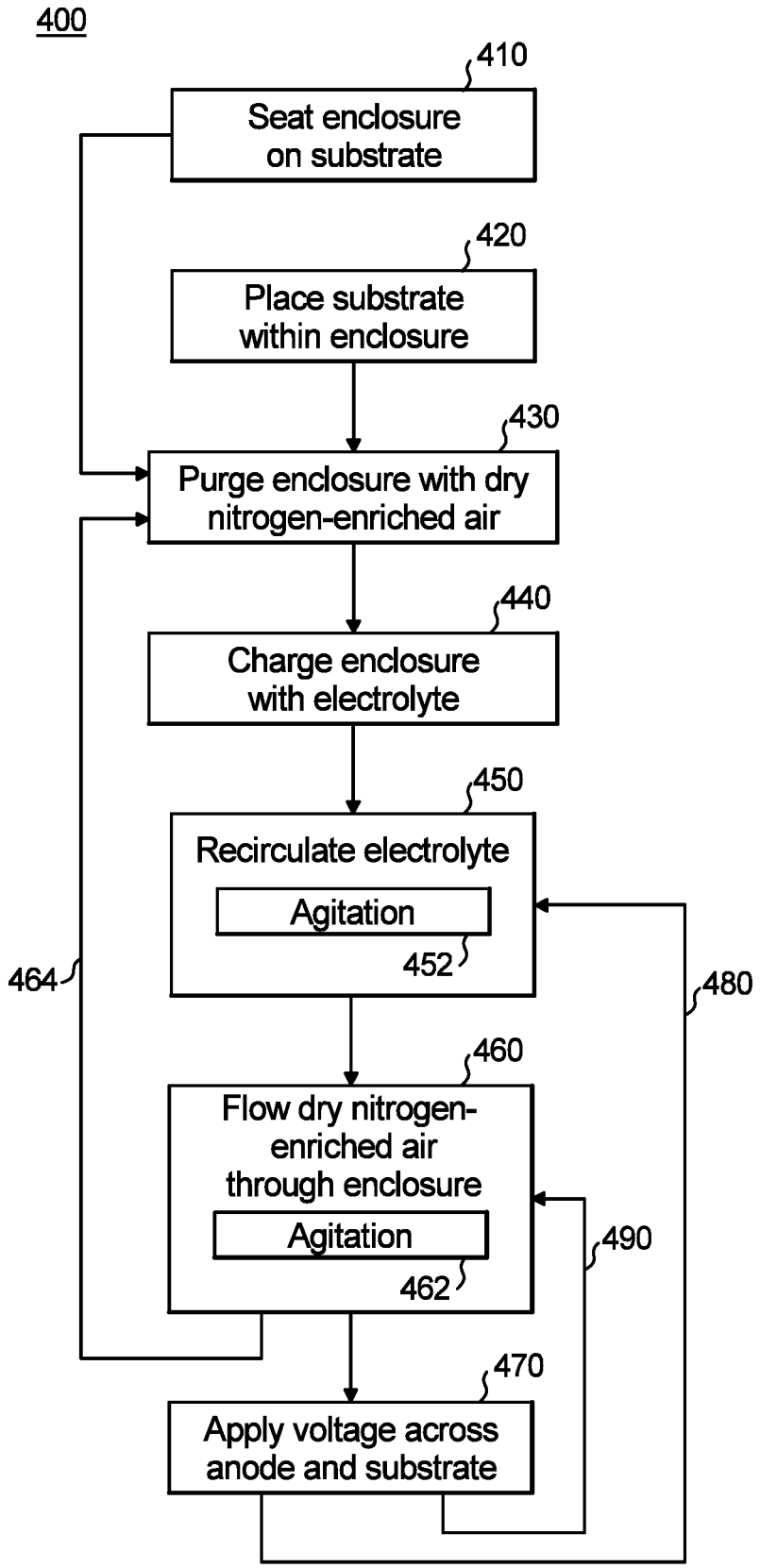
FIG. 4 is chart of a method for depositing a coating on a workpiece, showing steps of the method for in-situ or localized coating of a substrate.

With reference to FIG. 4, a method 400 of electroplating a workpiece is shown. Method 400 can include seating an enclosure, e.g., enclosure 102 (shown in FIG. 1), on a workpiece, e.g., workpiece 10 (shown in FIG. 1), for in-situ coating, as shown with box 410. Alternatively, method 400 can start with placing the substrate within the enclosure, e.g., enclosure 302 (shown in FIG. 3), for local coating, as shown with box 420. The workpiece can be pre-treated to remove oxides and/or surface contaminants like grease. Examples of pre-treatment processes include mechanical techniques like grit blasting and polishing as well as chemical processes like degreasing. Optionally, masking can be applied prior to or after pre-treatment to define the surface to be coated.

The enclosure is be purged with a flow of dry nitrogen-enriched air, e.g., dry nitrogen-enriched air 140 (shown in FIG. 1), for a predetermined time interval to remove residual moisture within the enclosure, as shown with box 430. The enclosure is then charged with an electrolyte, e.g., electrolyte 112 (shown in FIG. 1), as shown with box 440. The electrolyte is then recirculated through the enclosure, e.g., using recirculation module 108 (shown in FIG. 1), as shown box 450. The recirculation can provide mechanical agitation to the electrolyte, as shown with box 452.

Dry nitrogen-enriched air is flowed through the enclosure to provide a purged atmosphere, as shown with box 460. The dry nitrogen-enriched air can be introduced directly into the liquid electrolyte to agitate the liquid electrolyte, as shown with box 462. The dry nitrogen-enriched air can be flowed continuously through the enclosure subsequent to purging the enclosure, as shown with arrow 464. This provides continuous purging of the enclosure to remove moisture and/or oxygen from the enclosure during preparation and actual coating of the substrate.

Voltage is thereafter applied across the anode, e.g., anode 116 (shown in FIG. 1), and the substrate to develop a coating over at least a portion of the substrate. The coating can be developed while electrolyte is continuously recirculated, as shown with arrow 480, and/or with continual renewal (or while maintaining) of the purge flow of dry nitrogen enriched air, as shown with arrow 490.

Cadmium is commonly used as corrosion protection coating on structures like fasteners, propeller barrels, electrical connectors, and press-fit high strength bolts used in turboprop propellers aircraft. The use of cadmium in such applications is increasingly discouraged due to health concerns in recent years, as exemplified by the European Union safety and regulatory agency REACH listing cadmium as a substance of very high concern. This has led to use of alternative coatings, such as zinc and aluminum flake coatings with fluoropolymer topcoats, in applications traditionally employing cadmium. An exemplary technique is Dacrosealing®, available from NOF Metal Coatings of Chardon, Ohio. While satisfactory for their intended purpose, there remains a need for cadmium-free coatings with properties more closely conforming to those of traditional cadmium coatings, particularly with respect to corrosion protection, lubricity, and substrate adhesion.

In embodiments described herein, electroplating systems and methods are used to electroplate cadmium-free aluminum coatings on substrate surfaces. The coatings can be applied using a mobile electroplating system for coating components in a field service environment while providing sufficient inert to reliably develop aluminum coatings on substrates. In certain embodiments an enclosure is coupled to a component requiring coating repair, an air separator providing sufficient environmental control to the enclosure interior for coating the component in-situ, eliminating the need to return the component to a depot for repair. In accordance with certain embodiments, the component can be placed within an electrolyte bath within the enclosure, the air separator providing sufficient environmental control within the enclosure for coating the component. This enables on-wing or flight line repair of components with damaged coatings, reducing downtime by eliminating the need to return a damaged component to a depot or factory setting for repair.

In certain embodiments, electroplating systems described herein include a plating head with a housing containing an anode, an electrolyte recirculation module, and an air separation module. The air separation module can maintain a protective atmosphere for developing a coating using a material that is reactive with moisture and/or oxygen. The recirculation module can recirculate electrolyte to ensure electrolyte consistency. The electrolyte can include a particulate dispersion of solid lubricant for co-deposition, providing lubricity in the coating developed using the electroplating system.

The methods and systems of the present disclosure, as described above and shown in the drawings, provide for in-situ application of cadmium-free coatings to substrates with superior properties including corrosion protection, lubricity, and adhesion similar to that of cadmium coatings on steel substrates. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. An electroplating apparatus, comprising:

an enclosure for water sensitive electrolytes having an interior and a plurality of ports for circulating dry inerting gas and electrolyte through the enclosure interior;

an air separation module in fluid communication with the enclosure interior for supplying the dry inerting gas to the enclosure interior;

a porous body supported within the enclosure interior; and wherein the enclosure is divided by a wall into an inner chamber and an outer chamber, wherein the inner chamber and the outer chamber are fluidly connected by the porous body seated in a work piece aperture, and wherein an anode is disposed within the inner chamber, and wherein the porous body is seated partially within the outer chamber and seated partially within the inner chamber.

2. The apparatus as recited in claim 1, wherein the dry inerting gas is dry nitrogen enriched air generated in-situ with the air separation module.

3. The apparatus as recited in claim 1, wherein the air separation module includes a membrane configured to remove oxygen and moisture from compressed air provided thereto.

4. The apparatus as recited in claim 1, wherein the electrolyte comprises a chloroaluminate ionic liquid.

5. The apparatus as recited in claim 1, wherein the electrolyte comprises a solid lubricant dispersed within the electrolyte.

6. The apparatus as recited in claim 1, wherein the ports include an inerting gas inlet port arranged below a surface of liquid electrolyte contained within the enclosure interior.

7. The apparatus as recited in claim 6, wherein the ports include a vent port arranged above the surface of the liquid electrolyte contained within the enclosure interior.

8. The apparatus as recited in claim 1, further comprising a recirculation module in fluid communication with the enclosure interior.

9. The apparatus as recited in claim 8, wherein the ports include a recirculation outlet port fluidly coupling the recirculation module with the enclosure interior.

10. The apparatus as recited in claim 8, wherein the ports include a recirculation return port fluidly coupling the recirculation module with the enclosure interior.

11. The apparatus as recited in claim 1, further comprising an anode supported within the enclosure interior.

12. The apparatus as recited in claim 11, wherein the anode is a sacrificial anode including aluminum.

13. The apparatus as recited in claim 1, wherein one of the ports is a workpiece aperture, the porous body being seated within the workpiece aperture.

14. The apparatus as recited in claim 13, further comprising a compression seal extending about the workpiece aperture.

15. An electroplating apparatus, comprising:

an enclosure for water sensitive electrolytes having an interior and a plurality of ports for circulating dry inerting gas and electrolyte through the enclosure interior; an anode supported within the enclosure interior;

a recirculation module in fluid communication with the enclosure interior through a plurality of the ports;

an air separation module in fluid communication with the enclosure interior through one of the port for supplying the dry inerting gas to the enclosure interior to sustaining plating using a non-aqueous electrolyte; and wherein the enclosure is divided by a wall into an inner chamber and an outer chamber, wherein the inner chamber and the outer chamber are fluidly connected by a porous body seated in a work piece aperture, and wherein an anode is disposed within the inner chamber, and wherein the porous body is seated partially within the outer chamber and seated partially within the inner chamber;

wherein a recirculation outlet port is in fluid communication with the outer chamber and a recirculation inlet port is arranged within the inner chamber.

* * * * *